US010753060B2

(12) United States Patent
Hau et al.

(10) Patent No.: US 10,753,060 B2
(45) Date of Patent: Aug. 25, 2020

(54) SILT FENCE PATCH AND METHODS THEREOF

(71) Applicant: Chesapeake Environmental Management, Inc., Bel Air, MD (US)

(72) Inventors: Joseph Arthur Hau, Jarrettsville, MD (US); Stephanie Novak Hau, Jarrettsville, MD (US); Matthew Blair Wiherle, Havre de Grace, MD (US)

(73) Assignee: Chesapeake Environmental Management, Inc., Bel Air, MD (US)

( * ) Notice: Subject to any disclaimer, the term of this patent is extended or adjusted under 35 U.S.C. 154(b) by 10 days.

(21) Appl. No.: 15/849,571

(22) Filed: Dec. 20, 2017

(65) Prior Publication Data

US 2019/0186098 A1 Jun. 20, 2019

(51) Int. Cl.
*E02D 17/20* (2006.01)
*E02D 37/00* (2006.01)

(52) U.S. Cl.
CPC ..... *E02D 17/202* (2013.01); *E02D 37/00* (2013.01); *E02D 2300/0065* (2013.01); *E02D 2300/0075* (2013.01)

(58) Field of Classification Search
CPC ..... E02D 17/202; E02D 37/00; E02D 2300/0065; E02D 2300/0075
See application file for complete search history.

(56) References Cited

U.S. PATENT DOCUMENTS 7,736,097 B2 * 6/2010 D'Andreta ..... B32B 3/10 256/12.5
7,901,160 B2 3/2011 D'Andreta et al.
2004/0076482 A1 * 4/2004 Singleton ..... E02D 17/20 405/302.6
2006/0133900 A1 * 6/2006 Singleton ..... E02D 17/20 405/302.7
2006/0280563 A1 12/2006 Glick
(Continued)

FOREIGN PATENT DOCUMENTS

CA 2396619 A1 * 2/2003 ..... B41M 3/12

OTHER PUBLICATIONS

Storm Water Compliance Specialists, http://www.stormwatercompliancespecialists.com/ (last visited Dec. 28, 2016).

*Primary Examiner* — Tara Mayo-Pinnock
(74) *Attorney, Agent, or Firm* — Hutchinson Law, LLC; Linda S. Hutchinson, Esq.

(57) ABSTRACT

A silt fence patch for repairing damage to silt fence is disclosed. A silt fence patch may comprise geotextile fabric, an adhesive layer, and a backing. The backing may include indicia of patches, such as patch weave direction, user instructions, or logos. A silt fence patch sheet may comprise multiple silt fence patches. The sheet may include a backing with indicia of each patch, or indicia of the patches may be printed directly on the sheet fabric. A method of repairing damage to silt fence may comprise identifying damage to the silt fence. A damage boundary may surround the damage. The method may further comprise identifying a patch size to cover the damage boundary. The method may further comprise selecting a patch having the identified patch size. Additionally, the method may comprise applying the selected patch to the damage boundary and smoothing the patch over the damage boundary.

20 Claims, 8 Drawing Sheets

(56) References Cited

U.S. PATENT DOCUMENTS

| | | | | |
|---|---|---|---|---|
| 2008/0020166 | A1* | 1/2008 | Esposito | A63C 5/003 428/41.7 |
| 2009/0324883 | A1* | 12/2009 | Gray et al. | B32B 7/12 428/136 |
| 2012/0040154 | A1* | 2/2012 | Dinescu et al. | D06Q 1/12 428/200 |
| 2013/0294847 | A1* | 11/2013 | Milton | E02D 29/02 405/302.7 |
| 2014/0154018 | A1* | 6/2014 | Singleton | E02B 3/00 405/302.7 |
| 2015/0159305 | A1 | 6/2015 | Booth | |
| 2015/0306843 | A1* | 10/2015 | White | B32B 5/024 428/195.1 |
| 2016/0128405 | A1* | 5/2016 | Schulz | B44C 1/10 2/244 |

* cited by examiner

SILT FENCE PATCH AND METHODS THEREOF

BACKGROUND OF THE INVENTION

Soil disturbed at construction sites may runoff into natural water bodies, such as streams, lakes, and estuaries, or onto roads. The environmental impacts of sediment-laden water entering wetlands, streams, or waters of the United States may be significant: failed re-vegetation efforts post-construction, degradation of aquatic habitats natural to the construction sites, or sediment clogs of storm sewers. Reducing the environmental impacts of the disturbed soil may necessarily require control of this sediment-laden runoff. Accordingly, a construction plan may comprise approaches to maintain soil original to a construction site at the construction site.

Silt fence may function to keep soil local to a construction site during construction activities. Silt fence installed at a construction site may generally comprise at least one silt fence section, which may comprise end posts and porous fabric stretched between the end posts. As sediment-laden runoff flows from the construction site to appropriately placed silt fence, the porous fabric may limit the transport of eroded or disturbed soil from the construction site. Specifically, the silt fence may slow the flow of sediment-laden runoff water and separate the runoff components. The sediment may drop out and settle at the silt fence and water may flow through the silt fence. The silt fence may form a pond boundary as the dropped sediment forms a sediment pond of local soil. Accordingly, silt fence may separate construction site runoff into water and sediment, and may help form a boundary for a sediment pond at the construction site.

As described herein above, silt fence installed at a construction site may comprise porous fabric. Characteristics of the porous fabric, such as permeability, or permittivity, may support separating construction site runoff into sediment and water. However, holes, rips, ultra violet degradation, or other damage to the porous fabric may impact silt fence integrity. If the installed silt fence is unable to separate runoff components, at the very least, adjacent storm drains may clog. If the installed silt fence is unable to create a sediment pond, at the very least, receiving waters may suffer. Accordingly, construction plans may comprise approaches to maintain silt fence integrity.

SUMMARY OF THE PRESENT INVENTION

Various exemplary embodiments of the present disclosure may demonstrate one or more of the invention features. Other features and advantages of this invention will become apparent from the following detailed description of the presently preferred embodiment of the invention, taken in conjunction with the accompanying drawings.

In accordance with an exemplary embodiment, in general, the present invention provides a silt fence patch comprising a geotextile fabric, the geotextile fabric having a front side and a back side. The silt fence patch further comprises an adhesive in communication with the back side of the fabric.

In accordance with another exemplary embodiment, the present invention also includes a silt fence patch sheet comprising a geotextile fabric, the geotextile fabric having a front side and a back side. The silt fence patch sheet further comprises indicia of at least one silt fence patch.

In accordance with a further exemplary embodiment, the present invention further includes a method comprising identifying damage in a silt fence, the damage having a damage boundary. The method further comprises identifying a patch size to cover the damage boundary. The method further comprises selecting a patch having the identified patch size. Additionally, the method comprises applying the selected patch to the damage boundary.

It is to be understood that both the foregoing general description and the following detailed description are exemplary and explanatory only and are not restrictive of the present disclosure or claims.

BRIEF DESCRIPTION OF THE DRAWINGS

The drawings referenced herein are incorporated in and form part of the specification. The drawings illustrate one or more exemplary embodiments of the present disclosure and together with the description serve to explain various principles and operations. Implications that the drawings illustrate all embodiments of the invention are not to be made.

DETAILED DESCRIPTION OF THE INVENTION

Reference will now be made in detail to various exemplary embodiments of the present disclosure, examples of which are illustrated in the accompanying drawings.

It will be readily understood that the components of the present invention, as generally described and illustrated in the figures herein, may be arranged and designed in a wide variety of different configurations. Thus, the following detailed description of the embodiments of the silt fence patch and methods of the present invention, as presented in the figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearance of the phrases "a select embodiment," "in one embodiment," or "in an embodiment" in various places throughout this specification are not necessarily referring to the same embodiment.

Features, structure, or characteristics described herein may be combined in any suitable manner in one or more embodiments. One skilled in the relevant art will recognize, however, that the invention may be practiced without one or more of the specific details, or with other methods, components, or materials. In other instances, well-known materials or processes are not shown or described in detail to avoid obscuring aspects of the invention. The following description, which shows by way of illustration specific embodiments in which the invention may be practiced, is intended only by way of example. That is, the following description simply illustrates certain selected embodiments of a silt fence patch and methods that are consistent with the invention as claimed herein. It is to be understood that other embodiments may be utilized because structural and process changes may be made without departing from the scope of the present invention.

Silt fence may function to keep soil local to a construction site during construction activities. The silt fence may comprise porous fabric, which is subject to damage. For example, damage to the silt fence may occur during transport of the silt fence to the construction site. Alternatively, damage to the silt fence may occur during construction activities at the construction site. In an embodiment of the present invention, damage may comprise holes or rips. However, the types or categories of damage are provided for exemplary purposes, only, and are not meant to be limiting. Accordingly, construction site plans may contemplate damage to silt fence.

Figure 1A:
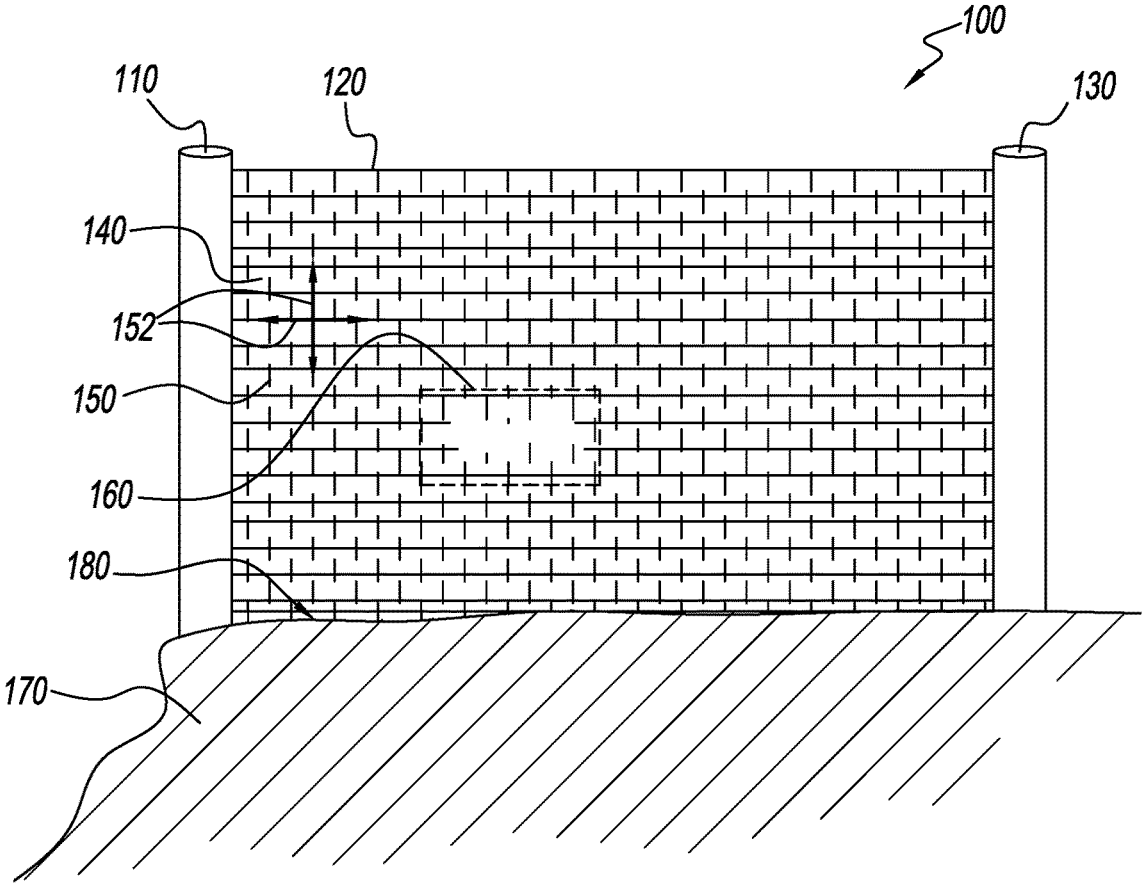
FIGS. 1A and 1B illustrate a front perspective of silt fence showing damage to the silt fence.
Figure 1B:
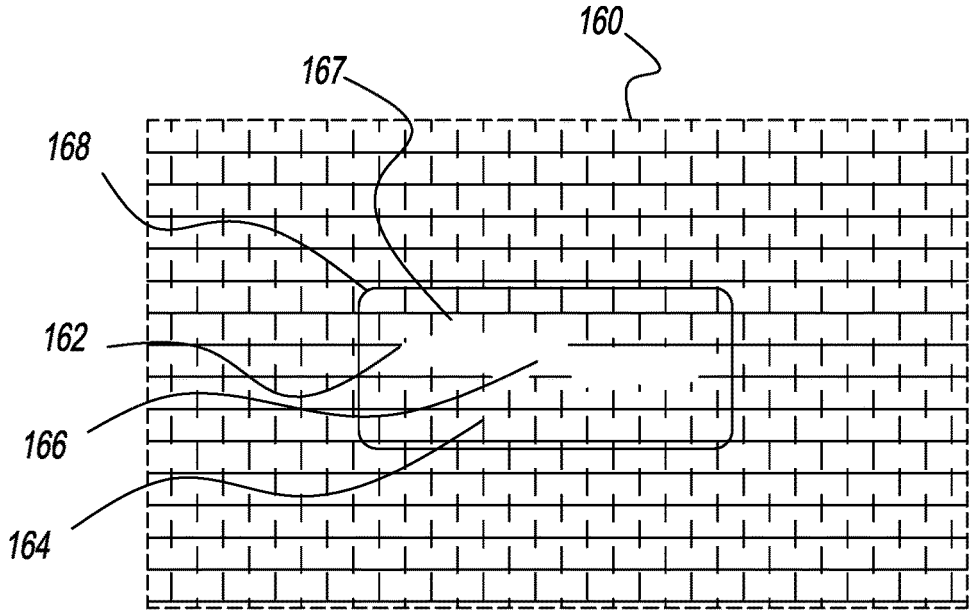

FIGS. 1A and 1B illustrate a front perspective of silt fence showing damage to the silt fence in accordance with the present disclosure. In an embodiment, for example, a silt fence in use may comprise at least one section of silt fence (100). The dimensions of the section of silt fence (100), such as height and width, are shown for exemplary purposes, and are not meant to be limiting. The number, alignment, and positioning of at least one section of silt fence (100) may support construction site plans. For example, as shown in FIG. 1A, positioning one section of silt fence (100) may create a boundary of a sediment pond (170) adjacent to the section of silt fence (100). In an embodiment, the sediment pond (170) may communicate with the section of silt fence (100) at an interface (180). The one section of silt fence (100), as shown in FIG. 1A, is not meant to be limiting, and is shown for exemplary purposes, only. Indeed, depending on construction site plans or needs at the construction site, a plurality of sections of silt fence may be aligned and positioned into a complete silt fence in use. Accordingly, a functioning silt fence may comprise at least one section of silt fence.

A section of silt fence (100) may comprise a first end post (110), a fabric (120), and a second end post (130). In an exemplary embodiment, the fabric (120) may comprise a front side (140) and a back side (not shown). In an exemplary embodiment, the fabric may comprise a fabric weave (150) having a fabric weave direction (152), as indicated by the arrows. As shown herein, for example, the fabric weave direction may be substantially vertical, substantially horizontal, some combination thereof. The fabric weave direction is shown for exemplary purposes, only, and is not meant to be limiting. Accordingly, silt fence may comprise structural supports and fabric.

In an embodiment, for example, the first end post (110) and the second end post (130) may be positioned and used to hold and stretch the fabric (120). For example, in an embodiment, the stretch of the fabric (120) may encourage permeability or support formation of a sediment pond (170). The positioning of the first end post (110), the second end post (130), and the fabric (120), are shown for exemplary purposes. In accordance with the present invention described herein, construction of a section of silt fence (100) and positioning of a first end post (110) and a second end post (130) relative to a fabric (120) may support silt fence functionality. Accordingly, construction of a section of silt fence may reflect construction site plans.

As described herein above, a section of silt fence (100) may comprise a first end post (110), a second end post (130), and a fabric (120). In use, the fabric (120) component of a section of silt fence (100) may function to trap soil particles from sediment-laden runoff and may support settlement of the soil particles into a sediment pond. In an exemplary embodiment, the fabric (120) may comprise a geotextile fabric, and choice of geotextile fabric may support silt fence functionality. For example, in an embodiment, geotextile fabric may be chosen based on permeability or permittivity characteristics. In another exemplary embodiment, geotextile fabric may be chosen based on water resistance or resistance to ultra violet degradation characteristics. Indeed, environmental conditions, transport conditions, and construction activities, for example, may influence a choice of geotextile fabric for use in silt fence. The geotextile fabric characteristics described herein are not meant to be limiting, and are shown for exemplary purposes, only. Accordingly, silt fence may comprise geotextile fabric, and the geotextile fabric may comprise characteristics supporting construction plans.

In an exemplary embodiment, as shown in FIGS. 1A and 1B, a section of silt fence (100) may comprise damage (160). As described herein above, in an embodiment of the present invention, for example, a section of silt fence (100) may comprise fabric (120), and the fabric may comprise geotextile fabric. As is understood by persons in the art, geotextile fabrics may be formed from multiple fibers. For example, geotextile fabrics may be formed as a network of polyester or other synthetic fibers. Damage to geotextile fabrics may comprise separation of the fibers based on breakage of the fibers. An insert of the damage (160) shows an expanded view of an exemplary embodiment of the damage (160). In an embodiment, a section of silt fence (100) may comprise damage (160), and the damage (160) may comprise a first group of fibers (162) separated from a second group of fibers (164). In an exemplary embodiment, a separation space (166) may form between the first group of fibers (162) and the second group of fibers (164). Accordingly, damage to silt fence may comprise separated geotextile fabric fibers.

As will be described herein below, a silt fence patch of the present invention may adhere to fabric (120) to cover and repair damage (160) to a section of silt fence (100). Specifically, in an embodiment of the present invention, as described herein below, a silt fence patch may communicate with an adhesive, and the adhesive may communicate with the fabric (120) of a section of silt fence (100). To that end, the fabric (120) may comprise an amount of surface area to support communication with the adhesive. In an exemplary embodiment, the surface area may comprise an adhering area (167). In an embodiment, damage (160) to the section of silt fence (100) may comprise the adhering area (167) surrounded by a damage border or damage boundary (168). In other words, in an exemplary embodiment of the present invention, the damage (160) may comprise a damage boundary (168), and the damage boundary (168) may surround the first group of fibers (162), the second group of fibers (164), the separation space (166), and the adhering area (167). Accordingly, damage to silt fence fabric may comprise an area of fabric supporting adhesive functions.

Silt fence may be manufactured as a roll and installed in 6-foot sections. Each 6-foot section of silt fence may be installed between two supporting posts. In an embodiment, the supporting posts may be provided during silt fence installation. In another embodiment, for example, a roll may include wooden posts already stapled to the silt fence at 6-foot intervals. To that end, the posts may identify each separate 6-foot section. Further, the stapled posts may support silt fence installation. Accordingly, silt fence manufacture may support silt fence installation.

Regulations may require that compromised silt fence be replaced with a new 6-foot section of silt fence. This replacement process may require unplanned time and resources. In other words, processes for repairing damaged silt fence may impact labor and supply costs and construction schedules. Rather than repairing damage to silt fence with replacement sections of silt fence, an embodiment of the present disclosure provides for a silt fence patch. For example, in an embodiment of the invention described herein, a silt fence patch may be applied in situ to silt fence in use at a construction site. Accordingly, a silt fence patch may reduce construction plan impacts associated with replacement sections.

Figure 2:
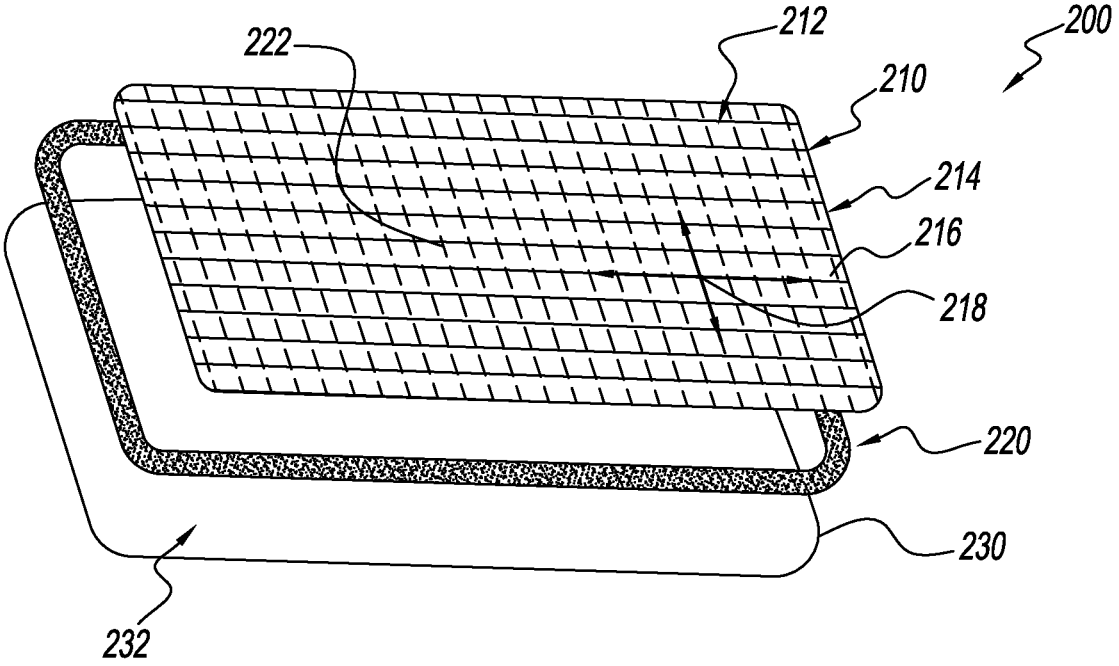
FIG. 2 illustrates a perspective view of a silt fence patch.

FIG. 2 illustrates a perspective view of a silt fence patch in accordance with the present disclosure. In an exemplary embodiment, a silt fence patch (200) may comprise a geotextile fabric (210), an adhesive layer (220), and a backing (230). In an embodiment, for example, the geotextile fabric (210) may comprise a front side (212) and a back side (not shown). In an exemplary embodiment, the geotextile fabric (210) may further comprise an edge (214). As described herein above, geotextile fabric may comprise a network or weave of fibers. With that in mind, as visible from the front side (212) of the geotextile fabric (210), the geotextile fabric (210) may further comprise a fabric weave (216) having a patch weave direction (218), as indicated by the arrows. As shown herein, for example, the patch weave direction may be substantially vertical, substantially horizontal, some combination thereof. The patch weave direction is shown for exemplary purposes, only, and is not meant to be limiting. Accordingly, a silt fence patch may comprise a geotextile fabric having a visible woven pattern.

As described with respect to FIG. 1A, a section of silt fence (100) may comprise fabric (120). As further described, the fabric (120) may demonstrate characteristics appropriate to silt fence functions, such as water resistance, resistance to ultra violet degradation, and permittivity or permeability. In accordance with an embodiment of the present invention, as described herein in FIGS. 1A, 1B and 2, a silt fence patch (200) may attempt to maintain the demonstrated characteristics of a section of silt fence (100) when the silt fence patch (200) adheres to an adhering area (167). To do so, a silt fence patch (200) may comprise geotextile fabric (210), and the geotextile fabric (210) may be same or similar fabric as the section of silt fence (100) being repaired. In this way, for example, integrity of the silt fence may be restored quickly, easily, effectively, and economically and impacts to silt fence function or integrity may be minimized. Accordingly, a silt fence patch may comprise fabric at least similar to silt fence fabric.

In an exemplary embodiment, the silt fence patch (200) may further comprise an adhesive layer (220) in communication with the geotextile fabric (210). In an exemplary embodiment, the adhesive layer (220) may promote adhesion between the geotextile fabric (210) and silt fence fabric (not shown) of a section of silt fence, as described in FIGS. 1A and 1B. To do so, for example, an adhesive layer may withstand temperature and moisture variations encountered throughout a construction project. The present disclosure does not limit a choice of adhesive, as adhesives with desired characteristics are contemplated. Accordingly, in situ requirements may drive choice of adhesive.

In an embodiment of the present invention, the adhesive layer (220) may form an adhesive bead. The location, size, and shape of the bead shown is for exemplary purposes, only, and is not meant to be limiting. Indeed, many qualities, such as adhesion and curing qualities, may impact the bead. For example, a bead position, size, and shape may maximize adhesion between a silt fence patch (200) and a damage boundary of a section of silt fence. Alternatively, a bead position, size, and shape may maximize runoff flow through a section of silt fence. In an exemplary embodiment, a bead position, size, and shape may balance these potentially conflicting considerations. For example, in an embodiment, the adhesive layer (220) may be positioned substantially close to the edge (214) of the geotextile fabric (210). In an additional exemplary embodiment, the adhesive layer (220) may be limited to surface area near the edge (214) of the geotextile fabric (210), and may not communicate with a center (222) of the geotextile fabric (210). Accordingly, a silt fence patch may comprise an adhesive layer, which may support silt fence functionality.

In an exemplary embodiment, the silt fence patch (200) may further comprise a backing (230) in communication with the adhesive layer (220). In an exemplary embodiment, the backing (230) may comprise a first side (232) in communication with the adhesive layer (220), and a second side (not shown). The backing (230) may protect the adhesive layer (220) prior to use of the silt fence patch (200) to repair damage to a section of silt fence. In another embodiment, for example, the first side (232) of the backing (230) may communicate with the back side (not shown) of the geotextile fabric (210). With this in mind, in an exemplary embodiment, the protective functions of the backing (230) may extend to protecting the back side (not shown) of the geotextile fabric (210). Accordingly, a backing may protect either or both an adhesive layer and geotextile fabric prior to use in repairing damage to a silt fence.

In an exemplary embodiment, indicia may be printed on the second side (not shown) of the backing (230). Indicia may comprise, for example, instructions for use of the silt fence patch (200), weave direction of the silt fence patch (200), or a supplier's logos. The types of indicia are provided for exemplary purposes, only, and are not meant to be limiting. Accordingly, a silt fence patch may comprise a backing, and the backing may communicate indicia.

Figure 3A:
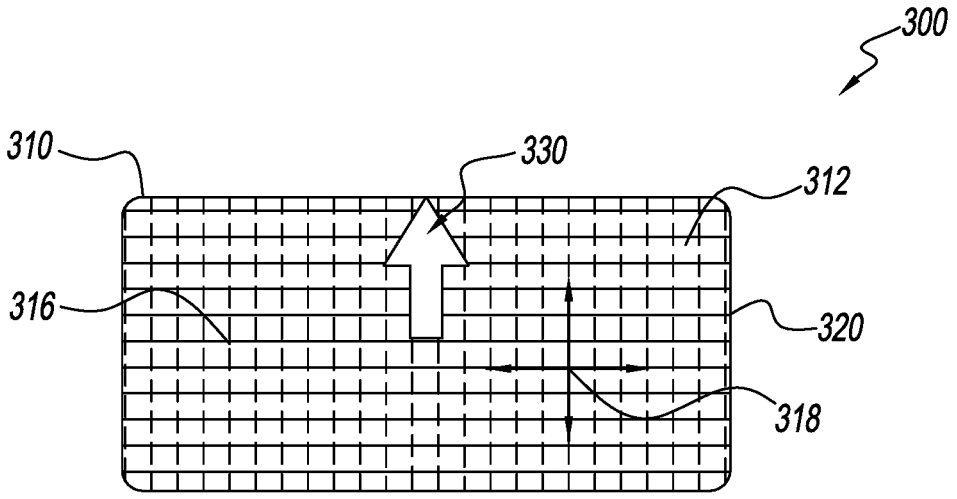
FIGS. 3A-3B illustrate front perspectives of a silt fence patch with visible indicia.
Figure 3B:
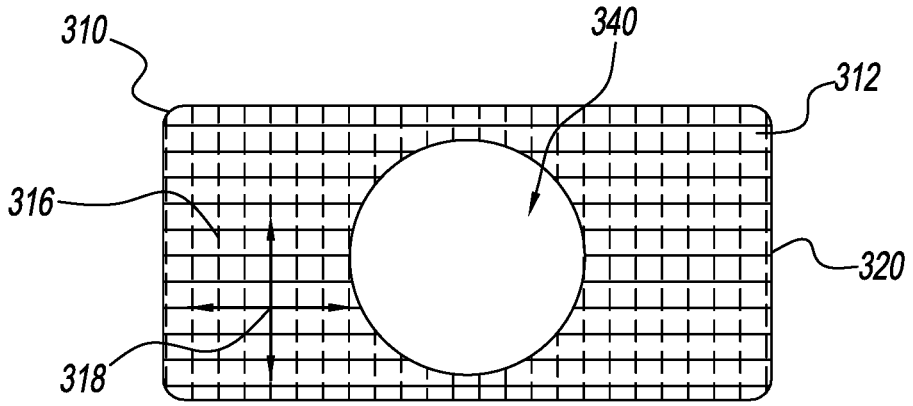

As described herein above, indicia, such as instructions, patch weave direction, or logos may be printed on a backing (230) of a silt fence patch (200). In an alternative embodiment, the indicia may be printed directly on the geotextile fabric (210) of the silt fence patch (200). FIGS. 3A and 3B illustrate front perspectives of a silt fence patch with visible indicia in accordance with the present disclosure. In an exemplary embodiment, as shown in FIGS. 3A and 3B, a silt fence patch (300) may comprise at least a geotextile fabric (310) having a front side (312) and a back side (not shown). In an embodiment, for example, the geotextile fabric (310) may further comprise a fabric weave (316) having a patch weave direction (318), as indicated by the arrows. As shown herein, for example, the patch weave direction may be substantially vertical, substantially horizontal, some combination thereof, or some other direction. The patch weave direction is shown for exemplary purposes, only, and is not meant to be limiting. Accordingly, a silt fence patch may comprise a side available for communicating indicia.

In an exemplary embodiment, silt fence patch orientation may impact silt fence functionality. For example, as described herein above, both a section of silt fence fabric and silt fence patch fabric may comprise geotextile fabrics. The geotextile fabrics may comprise a network of woven fibers. With respect to a section of silt fence fabric, pockets of air may form between the woven fibers, and the pockets may support flow of runoff through the section of silt fence. The larger the pockets, the greater the amount of fluid flow through the section of silt fence. At the same time, the larger the pockets, the less likely the silt fence may trap sediment on a front side of the section of silt fence to form a sediment pond. Accordingly, silt fence fabric weave may impact silt fence functionality.

Further, misalignment of patch weave direction to fabric weave direction may reduce pocket size and may impact silt fence functionality. In an exemplary embodiment, as shown in FIG. 3A, an indicia (330) printed on the front side (312) of the silt fence patch (300) may comprise an arrow or other indicia of patch weave direction (318). The use of an arrow is for exemplary purposes, only, as a variety of indicia may support aligning the patch weave direction (318) with the silt fence weave direction. The indicia shape and position relative to an edge (320) of the patch (300) is provided for exemplary purpose, only, and is not meant to be limiting. Accordingly, indicia displayed directly on a silt fence patch or on a silt fence patch backing may support maintaining silt fence functionality.

In another exemplary embodiment, as shown in FIG. 3B, a logo (340) may be printed on a front side (310) of a patch (300). The logo shape and position relative to an edge (320) of the patch (300) is provided for exemplary purpose, only, and is not meant to be limiting. Indicia are not limited to patch weave direction and logos, as all forms of indicia are contemplated in the present disclosure. Accordingly, indicia displayed directly on a silt fence patch or on a silt fence patch backing may provide identifying information.

Figure 4:
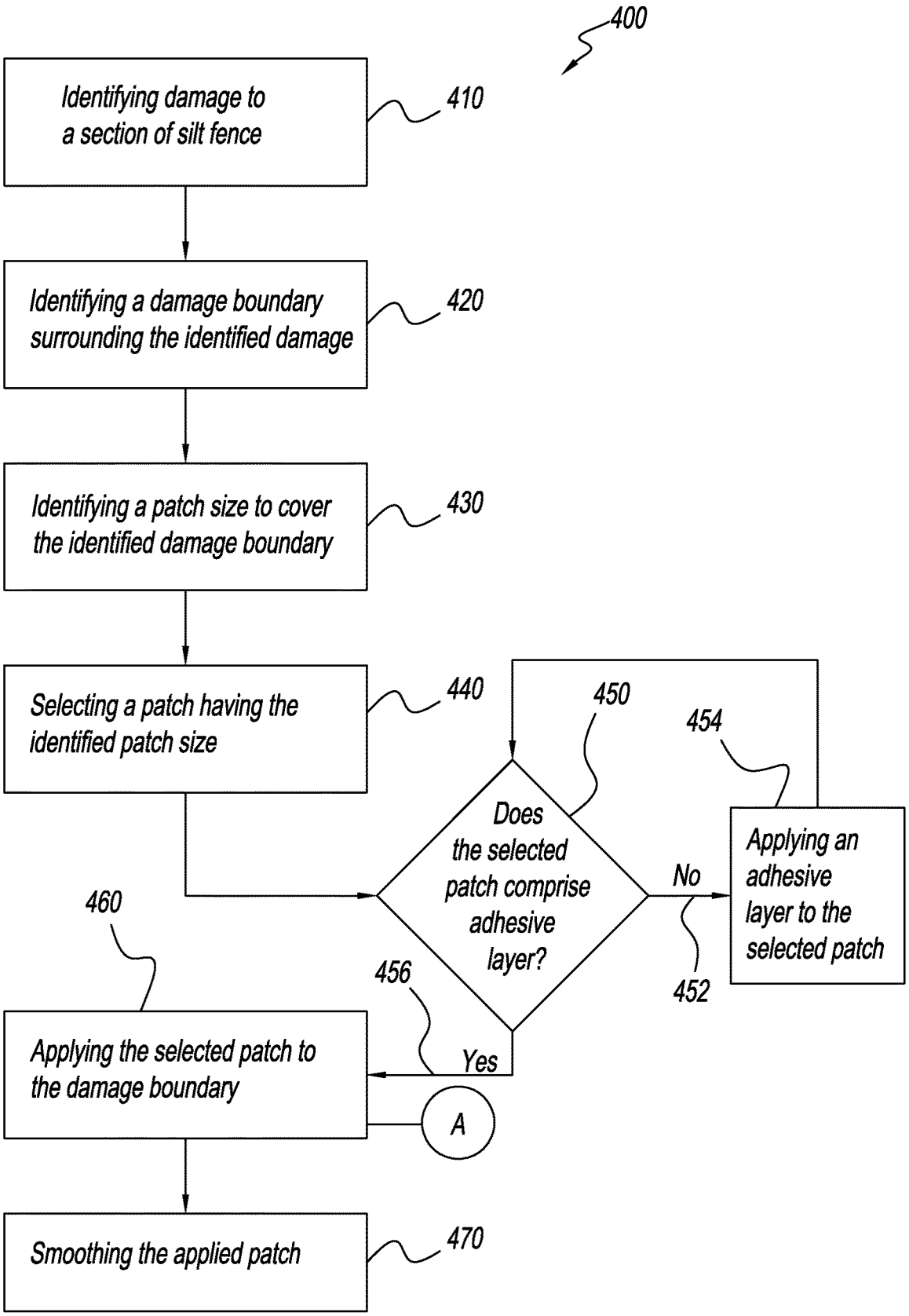
FIG. 4 illustrates a flow diagram showing repairing a silt fence.

FIG. 4 illustrates a flow diagram showing repairing a silt fence in accordance with the present disclosure. In an exemplary embodiment, a method of repairing a silt fence (400) may begin with identifying damage to a section of silt fence (410). Damage may comprise, for example a rip, hole, tear, or other damage. After identifying damage to a section of silt fence, a method of repairing a silt fence (400) may comprise identifying a damage boundary surrounding the identified damage (420). With reference to FIG. 1B, in an exemplary embodiment, a damage boundary (168) may comprise an adhering area (167). The adhering area (167) may comprise a surface area of silt fence immediately adjacent to the identified damage. The size, shape, and surface area of the adhering area (167) within the damage boundary (168) may, for example, provide surface area for an adhesive to communicate with a damaged section of silt fence. In doing so, the adhering area (167) may promote secure adhesion of a silt fence patch to a damaged section of silt fence. With this in mind, a method of repairing a silt fence (400) may further comprise identifying a patch size to cover the identified damage boundary (430) and selecting a patch having the identified patch size (440). A silt fence patch covering the identified damage boundary will necessarily cover the adhering area, as described in FIG. 1B. Accordingly, a size of a damage boundary may influence a size of a selected silt fence patch.

A silt fence patch, as described in FIG. 2, may comprise an adhesive layer and a backing, for example, to protect the adhesive layer prior to use of the silt fence patch. However, resource or other considerations may suggest manufacturing a silt fence patch without an adhesive layer and applying an adhesive layer in situ. With that in mind, a silt fence patch, in accordance with an alternative embodiment of the present invention, may comprise geotextile fabric, only. To that end, a method of repairing a silt fence (400) may comprise identifying whether the selected patch comprises an adhesive layer (450). If no (452), a method of repairing a silt fence (400) may further comprise applying adhesive to the selected patch (454). Alternatively, if yes (456), a method of repairing a silt fence (400) may further comprise applying the selected patch to the damage boundary (460). In an alternative embodiment, if the selected patch does not comprise an adhesive layer, an adhesive layer may be applied directly to an adhering area within a damage boundary, as described in FIG. 1B. Accordingly, an adhesive layer may adhere a silt fence patch to a damaged section of silt fence.

In an exemplary embodiment, repairing a silt fence (400) may further comprise smoothing the applied patch (470). Smoothing the applied patch (470) may promote the adhesive layer forming a seal between the adhering area and the silt fence patch. Accordingly, repairing a silt fence may comprise applying and smoothing a silt fence patch to a damage boundary of a section of silt fence.

As shown in an embodiment of FIG. 4, a method of repairing silt fence (400) may comprise applying the selected patch to the damage boundary (460), which may comprise further considerations. As described herein above with respect to FIG. 3A, in an exemplary embodiment, a silt fence patch (300) may comprise a geotextile fabric (310). The geotextile fabric may comprise a patch weave direction (318). Similarly, as described in FIGS. 1A and 1B, a section of silt fence (100) may comprise a fabric (120). The fabric (120) may comprise a fabric weave direction (152). Accordingly, each of a section of silt fence and a silt fence patch comprises a weave direction.

Figure 5:
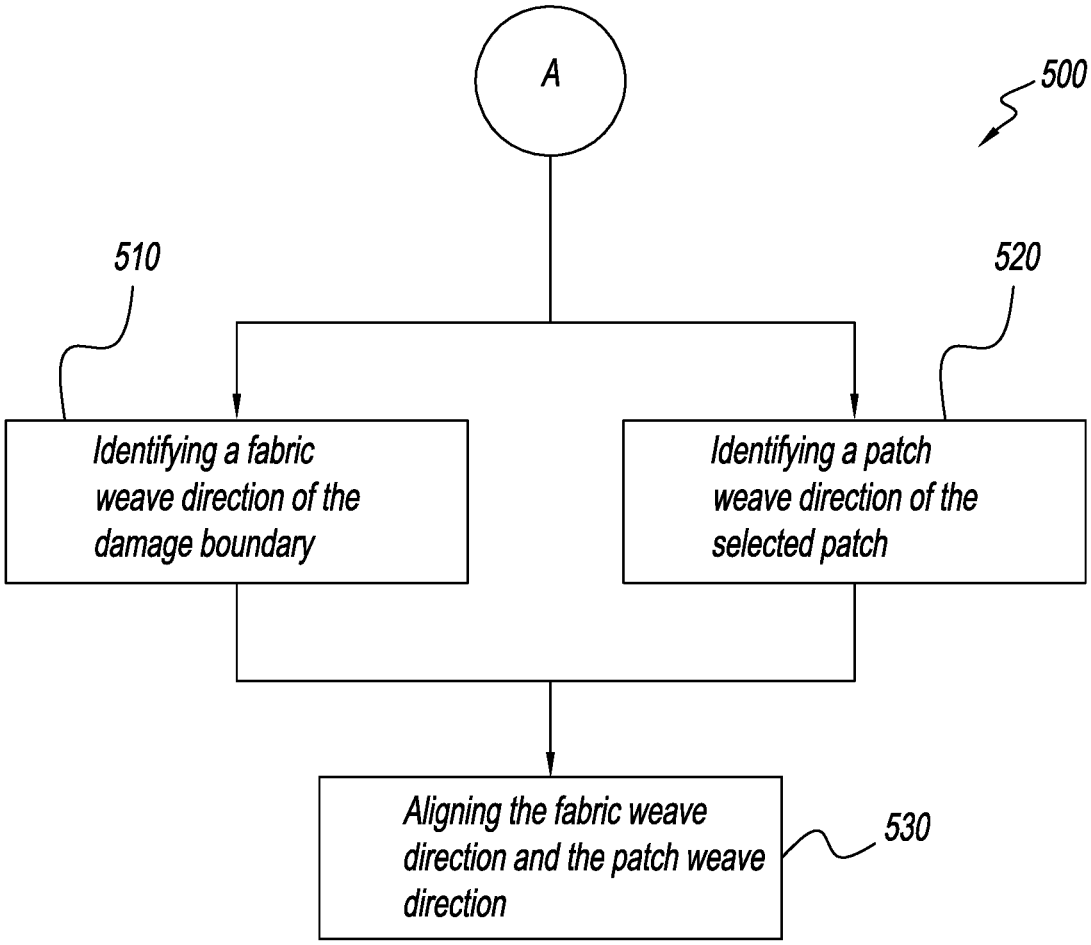
FIG. 5 illustrates a flow diagram showing aligning a patch weave direction with a silt fence fabric weave direction.

As described herein above, geotextile fabrics comprise fibers, and the fibers create pockets through which fluid may flow. Misalignment of patch weave direction relative to fabric weave direction may reduce available pocket size between fibers on a section of silt fence. That is, with reference to FIGS. 1A, 1B and 3A, misalignment of patch weave direction (318) to fabric weave direction (152) of a section of silt fence (100) may reduce runoff flow through a section of silt fence (100). FIG. 5 illustrates a flow diagram showing aligning a patch weave direction with a silt fence fabric weave direction in accordance with the present disclosure. In an embodiment, for example, as part of applying the selected patch to the damage boundary (460), as described in FIG. 4, a method of repairing a silt fence (400) may further comprise a method of aligning a patch weave direction with a silt fence fabric weave direction (500) of a section of silt fence. In an exemplary embodiment, a method of aligning a patch weave direction with a silt fence fabric weave direction (500) may comprise identifying a fabric weave direction of the damage boundary (510) and identifying a patch weave direction of the selected patch (520). In an embodiment, for example, using this information, a method of aligning a patch weave direction with a silt fence fabric weave direction (500) may further comprise aligning the fabric weave direction and the patch weave direction (530). Accordingly, a method of repairing a silt fence with an applied silt fence patch may contemplate relative weave directions of silt fence fabric and silt fence patch fabric.

Figure 6:
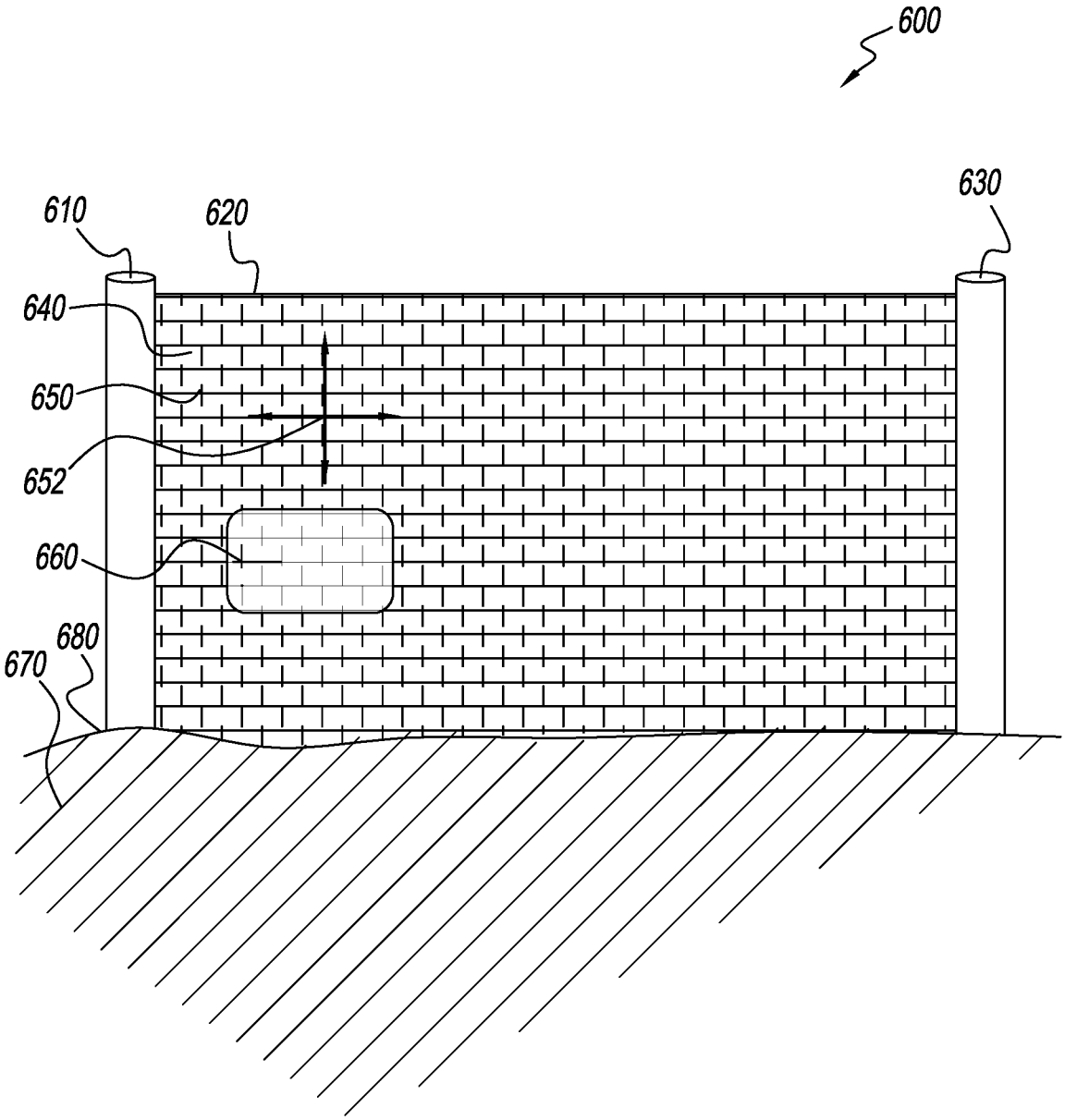
FIG. 6 illustrates a front perspective of repaired silt fence.

FIG. 6 illustrates a front perspective of repaired silt fence in accordance with the present invention. A section of repaired silt fence (600) may comprise a first end post (610), a fabric (620), and a second end post (630). In an exemplary embodiment of the present invention, a silt fence may comprise a single section or a plurality of sections of silt fence. As described in FIG. 1A, a number of sections of silt fence are provided for exemplary purposes, only, and is not meant to be limiting. In an exemplary embodiment, the fabric (620) may comprise a geotextile fabric. The fabric (620) may comprise a front side (640) and a back side (not shown). Additionally, in an exemplary embodiment, the fabric (620) may comprise a fabric weave (650) having a fabric weave direction (652), as indicated by the arrows. As shown herein, for example, the fabric weave direction may be substantially vertical, substantially horizontal, some combination thereof, or some other direction. The fabric weave direction is shown for exemplary purposes, only, and is not meant to be limiting. In an exemplary embodiment, as provided for in the present invention, a silt fence patch (660) may adhere to the fabric (620). As described above in FIGS. 1A, 1B and 4, in an exemplary embodiment, the silt fence patch (660) may adhere to an adhering area (not shown) within a damage boundary (not shown). As shown, in an exemplary embodiment, the silt fence patch (660) may cover the damage (not shown) and the damage boundary (not shown). As described herein above with respect to FIGS. 2, 3A, 3B, 4, and 5, the silt fence patch (660) may comprise a patch weave direction. In an embodiment, for example, patch weave direction and fabric weave direction may be aligned when applying a silt fence patch to a damage boundary. In an exemplary embodiment, aligning the patch weave direction to the silt fence fabric weave direction may maintain runoff flow volume through the section of repaired silt fence (600) and the damage boundary (not shown), and may maintain disturbed soil trapping functionality. Further, as described in FIGS. 3A and 3B, an exemplary embodiment of the silt fence patch (660) may comprise indicia comprising, for example, a patch weave direction, a logo, or some other indicia. Accordingly, an in situ silt fence repair using a silt fence patch may maintain runoff flow volume and sediment drop off.

In a further embodiment of the present invention, the section of repaired silt fence (600) may border a sediment pond (670). In a further exemplary embodiment, the sediment pond (670) may communicate with the section of repaired silt fence (600) at an interface (680). Accordingly, a silt fence patch may repair a section of silt fence, while allowing for runoff flow through the section of silt fence and sediment pond formation at the section of silt fence.

As described in FIG. 4, a method of repairing silt fence (400) may, at least, comprise selecting a patch having an identified patch size (440). As damage to sections of silt fence may occur more than once during construction activities, a construction site manager, for example, may prefer to maintain on site a plurality of silt fence patches, each silt fence patch in accordance with the present disclosure. Accordingly, selecting a silt fence patch may comprise selecting a silt fence patch from a plurality of silt fence patches.

Figure 7:
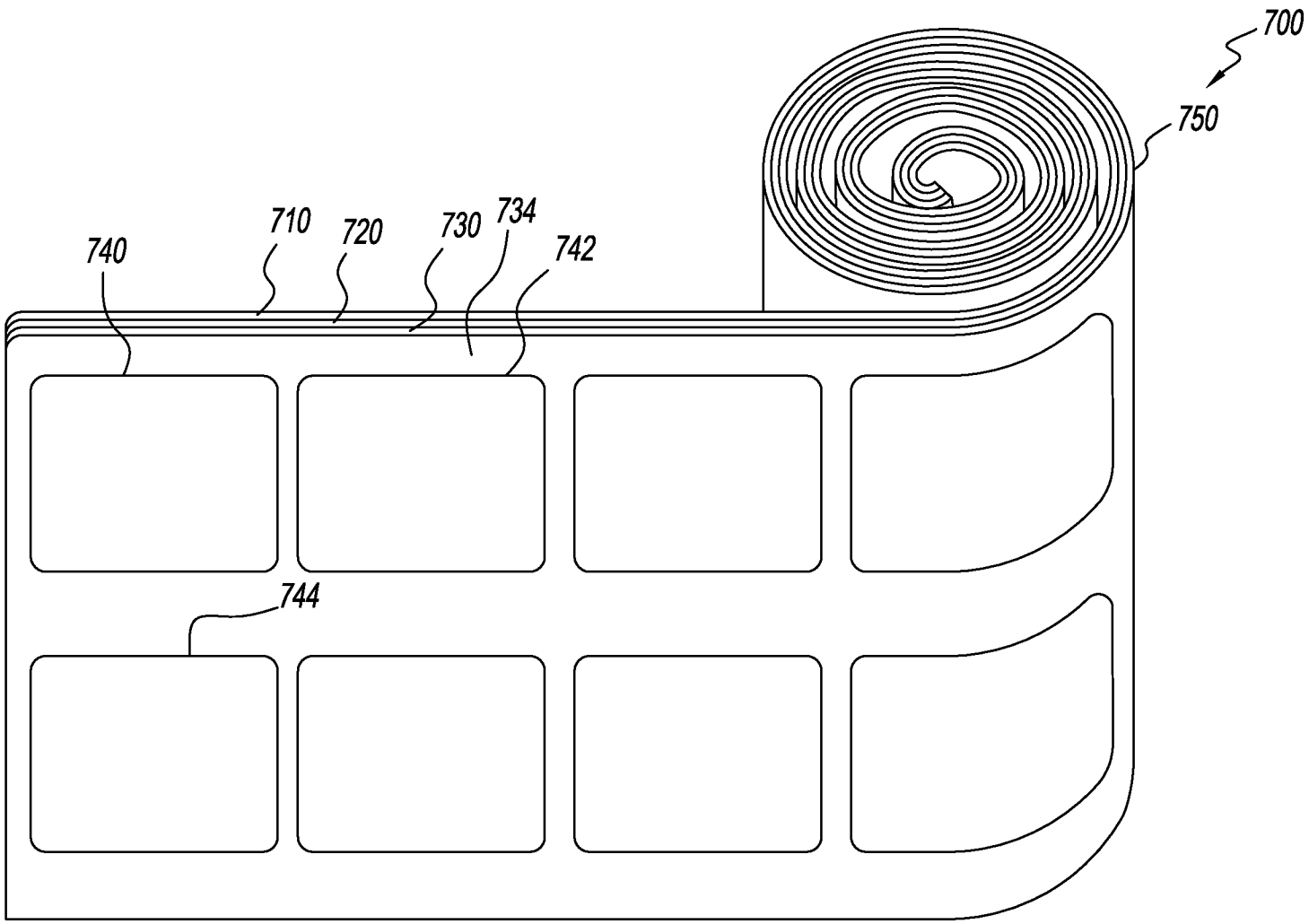
FIG. 7 illustrates a top perspective of a roll of silt fence patch sheet.

An exemplary embodiment of the present invention may comprise a sheet of silt fence patches, each silt fence in accordance with the present disclosure. FIG. 7 illustrates a top perspective of a silt fence patch sheet in accordance with the present invention. In an exemplary embodiment, a silt fence patch sheet (700) may comprise a geotextile fabric (710), an adhesive layer (720), and a backing (730). In an exemplary embodiment, the adhesive layer (720) may communicate with the geotextile fabric (710) and a first side (not shown) of the backing (730). In an embodiment, for example, the first side (not shown) of the backing (730) may protect the adhesive layer (720) or the geotextile fabric (710) from damage during transport or storage of the silt fence patch sheet (700) prior to use. Accordingly, a silt fence patch sheet may comprise at least a geotextile fabric.

In an exemplary embodiment, the backing (730) may comprise a second side (734). In an embodiment, for example, indicia may be printed, embossed, or scored on the second side (734) of the backing (730). The methods for communicating indicia onto the second side (734) of the backing (730) are provided for exemplary purposes, only, and are not meant to be limiting. Indicia may comprise, for example, an outline of a first silt fence patch (740). In an exemplary embodiment, indicia may further comprise, at least, an outline of a first silt fence patch (740) and an outline of a second silt fence patch (742). In a further exemplary embodiment, indicia may comprise, at least, an outline of a first silt fence patch (740), an outline of a second silt fence patch (742), and an outline of a third silt fence patch (744). In an exemplary embodiment, the outlines may comprise score lines. Descriptions of indicia are provided for exemplary purposes, only, and are not meant to be limiting. Further, the number and arrangement of indicia of outlines of silt fence patches on the backing (730) are provided for exemplary purposes, only, and are not meant to be limiting. Accordingly, a silt fence patch sheet may comprise a geotextile fabric, an adhesive layer and a backing, and the backing may communicate silt fence patch dimensions.

In an exemplary embodiment, the silt fence patch sheet (700) may comprise continuous and parallel forms of the geotextile fabric (710) and the backing (730). As described above, the adhesive layer (720) may communicate with both the geotextile fabric (710) and the backing (730). However, in an embodiment, the adhesive layer (720) may not form continuously between the geotextile fabric (710) and the backing (730). Similar to the silt fence patch described in FIG. 2, in an exemplary embodiment, the adhesive layer (720) may comprise an adhesive bead supporting application of a silt fence patch (not shown). For example, the adhesive layer may comprise an adhesive bead near an edge of, for example, an outline of a first silt fence patch (740), an outline of a second silt fence patch (742), an outline of a third silt fence patch (744), or any combination thereof. The number of adhesive beads is provided for exemplary purposes, only, and is not meant to be limiting. Further and similar to the silt fence patch described in FIG. 2, a bead position, size, and shape may maximize adhesion between a silt fence patch and a damage boundary of a section of silt fence. Alternatively, a bead position, size, and shape may maximize runoff flow through a section of silt fence. In an exemplary embodiment, a bead position, size, and shape may balance these potentially conflicting considerations. In an additional exemplary embodiment, the adhesive layer (720) may be limited to surface area near an edge of a silt fence patch (not shown), and may not communicate with a center of the silt fence patch (not shown). Accordingly, an adhesive layer of a silt fence patch sheet may promote silt fence patch functionality.

In another exemplary embodiment, the adhesive layer (720) may comprise an adhesive bead position, size, and shape that supports adhesion of the backing (730) to the geotextile fabric (710). In an embodiment, the adhesive layer (720) may, for example, support communication between the geotextile fabric (710) and the backing (730) during transport or storage of the silt fence patch sheet (700). With this in mind, in an exemplary embodiment, the backing (730) may protect the geotextile fabric (710) from damage due to, for example, external elements, such as construction debris, prior to use of the silt fence patch sheet (700). Accordingly, a silt fence patch sheet may comprise an adhesive layer, which may facilitate storing and transporting the silt fence patch sheet.

In another exemplary embodiment, the indicia may comprise user instructions for removing a silt fence patch from the silt fence patch sheet (700). In a further exemplary embodiment, the indicia may comprise instructions for repairing a section of silt fence with a silt fence patch, in accordance with the present disclosure. In another exemplary embodiment, indicia may comprise business identifiers, such as logos. The indicia may also comprise patch weave direction. The indicia discussed herein are provided for exemplary purposes, and are not meant to be limiting. Accordingly, a silt fence patch sheet comprising a geotextile fabric, an adhesive layer, and a backing may communicate user instructions.

In an exemplary embodiment, a silt fence patch sheet (700) may comprise a wide sheet, a long sheet, or some combination thereof. Ease of transportation and storage may influence dimensions of the silt fence patch sheet (700). In an exemplary embodiment of the present invention, as shown, the silt fence patch sheet (700) may form a roll (750). In this way, a construction site manager, for example, may manage a roll (750) comprising a silt fence patch sheet (700). In doing so, the construction site manager may manage a plurality of individual silt fence patches. In an embodiment, for example, the roll (750) may comprise a silt fence patch sheet (700) comprising approximately 100 feet in length and approximately one foot in width. The roll (750) may comprise a silt fence patch sheet (700), which may comprise at least one silt fence patch. The dimensions of the roll (750) and the number of silt fence patches provided therewith are provided for exemplary purposes, only, and are not meant to be limiting. In alternative embodiments, for example, the silt fence patch sheet (700) may fold into multiple smaller sheets, or may comprise a single, small, flat sheet. Accordingly, a form of silt fence patch sheet may facilitate transportation and storage of multiple silt fence patches.

As described herein above with respect to FIG. 7, a silt fence patch sheet (700) may comprise a geotextile fabric (710), an adhesive layer (720), and a backing (730). However, resource or other considerations may suggest manufacturing a silt fence patch sheet without an adhesive layer and applying an adhesive layer in situ. With that in mind, a silt fence patch sheet, in accordance with an alternative embodiment of the present invention, may comprise geotextile fabric, only. Indicia of multiple patches may be directly communicated onto the geotextile fabric (710). As described herein above, indicia may comprise outlines of multiple silt fence patches of the present invention. In an exemplary embodiment, the indicia may alternatively or additionally comprise instructions for removing a silt fence patch from the silt fence patch sheet (700), or instructions for using a silt fence patch to repair damage to a section of silt fence. In another embodiment, indicia may comprise business logos. In an embodiment, for example, indicia may comprise patch weave direction. In an embodiment, for example, communicated indicia may be printed, embossed, or stamped onto the geotextile fabric (710). Methods of communicating indicia directly onto geotextile fabric are provide herein for exemplary purposes, only, and are not meant to be limiting. As described in FIG. 4, as a removed silt fence patch may not comprise an adhesive layer, an adhesive layer may be communicated to the removed silt fence patch. With reference to FIGS. 1A and 1B, in an alternatively embodiment, an adhesive layer may be applied directly onto an adhering area of a damage boundary of a section of silt fence. Accordingly, a silt fence patch sheet may comprise geotextile fabric with communicated indicia.

As described above, in an exemplary embodiment of a present disclosure, a silt fence patch comprising geotextile fabric, an adhesive layer, and a backing may be used to repair damage to a section of silt fence. Also, as described above, a silt fence patch sheet may comprise a plurality of silt fence patches. When, for example, a rip or hole is identified in a section of silt fence in the field during normal construction inspections, an inspector may brush off any evident soil from the damaged area of the section of silt fence. The inspector may determine the proper patch size to use to cover the damaged area and cut a silt fence patch from a silt fence patch roll. To apply the silt fence patch to the damaged area, the inspector may remove the backing, which may comprise plastic or paper, from communication with the adhesive layer. The inspector may then apply the silt fence patch to the damaged area, and rub the silt fence patch with the removed backing to ensure a good seal. For optimal runoff flow, instructions on the backing of the silt fence patch roll may include an UP arrow, which may indicate patch weave direction. The inspector may reference this indicia to align the patch weave direction with the silt fence fabric weave direction. Accordingly, a silt fence patch, in accordance with the present invention, and selected from a roll of silt fence patches, may repair damage to a section of silt fence in situ.

Figure 8:
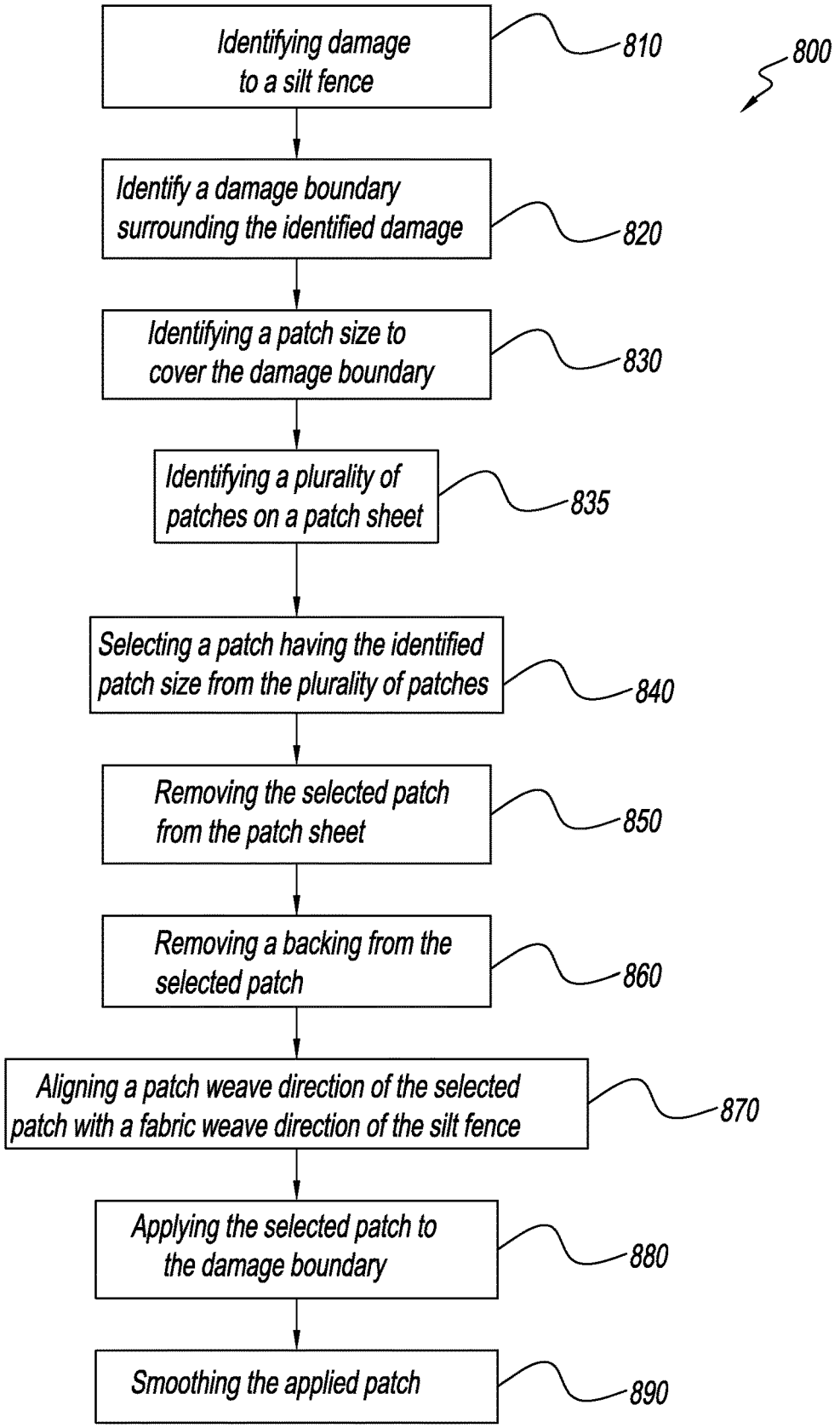
FIG. 8 illustrates a flow diagram showing repairing a silt fence.

FIG. 8 illustrates a flow diagram showing repairing a silt fence in accordance with the present disclosure. In particular, as described in FIG. 7, a silt fence patch sheet (700) may comprise a geotextile layer (710), adhesive layer (720), and a backing (730). The silt fence patch sheet (700) may identify at least one silt fence patch of the present invention. In an exemplary embodiment, a method of repairing a silt fence (800) may comprise at least one silt fence patch removed from a silt fence patch sheet. For example, a method of repairing a silt fence (800) may comprise identifying damage to a silt fence (810) and identifying a damage boundary surrounding the damage (820). With reference to a silt fence patch sheet (700), as described herein above in FIG. 7, a method of repairing a silt fence (800) may further comprise, for example, identifying a patch size to cover the damage boundary (830). As described herein above, in FIG. 7, a silt fence patch sheet may comprise a plurality of silt fence patches. With that in mind, a method of repairing a silt fence (800) may further comprise identifying a plurality of patches on a patch sheet (835) and selecting a patch having the identified patch size from the plurality of patches (840) on the patch sheet. In an exemplary embodiment, a method of repairing a silt fence (800) may further comprise removing the selected patch from the patch sheet (850). Accordingly, repairing damage to a section of silt fence may require selecting a silt fence patch from a silt fence patch sheet.

In an exemplary embodiment of the present invention, a method of repairing a silt fence (800) may further comprise removing a backing from the selected patch (860) and aligning a patch weave direction of the selected patch with a fabric weave direction of the silt fence (870). As described herein above with respect to FIGS. 1A and 1B, damage (160) to a section of silt fence (100) may comprise a damage boundary (168). The damage boundary (168) may comprise an adhering area (167) for communicating an adhesive layer to both a silt fence patch and the damaged section of silt fence. To that end, a fabric weave direction of a damage boundary, as described in FIG. 5, is the same as a fabric weave direction of the damaged section of silt fence. Accordingly, repairing a section of silt fence may comprise aligning a patch weave direction with a silt fence weave direction.

In a further exemplary embodiment, repairing a silt fence (800) may comprise applying the selected patch to the damage boundary (880) and smoothing the applied patch (890). Accordingly, a silt fence patch for repairing a section of silt fence may be selected from a sheet of silt fence patches, and the selected patch may be applied to cover damage to the section of silt fence.

It is to be understood that the various embodiments shown and described herein are to be taken as exemplary. Elements and materials, and arrangements of those elements and materials, may be substituted for those illustrated and described herein, parts may be reversed, and certain features of the present disclosure may be utilized independently, as would be apparent to one skilled in the art after having the benefit of the description herein. Changes may be made in the elements described herein without departing from the spirit and scope of the present disclosure and following claims, including their equivalents.

It is to be understood that the particular embodiments set forth herein are non-limiting, and modifications to structure, dimensions, materials, and methodologies may be made without departing from the scope of the present disclosure.

It is to be further understood that this description's terminology is not intended to limit the invention. For example, spatially relative terms, such as "front," "back," "top," "bottom," "side," and the like, may be used to describe one element's or feature's relationship to another element or feature as intended to connote the orientation of, for example, a silt fence patch and silt fence patch sheet as illustrated in the figures.

For the purposes of this specification and appended claims, unless otherwise indicated, all numbers expressing quantities, percentages or proportions, and other numerical values used in the specification and claims, are to be understood as being modified in all instance by the term "about" if they are not already. That is, unless indicated to the contrary, the numerical parameters set forth in the specification and claims are approximations that may vary depending on the desired properties sought to be obtained by the present disclosure.

What is claimed is:

1. A silt fence patch, comprising:
- a permeable patch, the permeable patch comprises
  - a permeable geotextile fabric, the fabric having a front side and a back side;
  - a permeable patch weave direction;
  - the permeable patch weave direction in alignment with a weave direction of at least one permeable silt fence panel in situ, and
  - an adhesive in communication with the back side of the fabric,
- wherein at least one permeable patch adheres to the at least one permeable silt fence panel in situ, wherein
  - a front surface of the at least one adhered permeable patch is positioned substantially orthogonally to sediment-laden stormwater runoff and the front surface communicates with the sediment-laden stormwater runoff, wherein
    - the at least one adhered permeable patch covers a damage in the at least one permeable silt fence panel in situ, and
    - the at least one adhered permeable patch filters sediment from the sediment-laden stormwater runoff and allows water from the sediment-laden stormwater runoff to escape through a back surface of the at least one adhered permeable patch.

2. The silt fence patch of claim 1, further comprising a first side of a backing in communication with the adhesive.

3. The silt fence patch of claim 2, further comprising indicia visible on a second side of the backing, the indicia is selected from the group consisting of an instruction, a graphic, and combinations thereof.

4. The silt fence patch of claim 1, wherein the fabric forms a shape.

5. The silt fence patch of claim 1, wherein the adhesive forms a bead in communication with the patch and the adhesive bead is positioned substantially close to an edge of the patch.

6. The silt fence patch of claim 5, wherein a surface area of the patch comprises a first surface area in communication with the adhesive bead and a second surface area free of adhesive, and wherein the second surface area is substantially greater than the first surface area.

7. The silt fence patch of claim 1, further comprising printed indicia visible on the front side of the fabric, the indicia is selected from the group consisting of the permeable patch weave direction, an instruction, a graphic, and combinations thereof.

8. A silt fence patch sheet, comprising:
- a geotextile sheet, the geotextile sheet comprises
  - a permeable geotextile fabric, the fabric having a front side and a back side; and
- indicia of a plurality of permeable silt fence patches;
  - wherein at least one permeable patch separated from the permeable sheet adheres to
  - at least one permeable silt fence panel in situ, wherein
    - a front surface of the at least one adhered permeable patch is positioned substantially orthogonally to sediment-laden stormwater runoff and the front surface communicates with the sediment-laden stormwater runoff, wherein
      - the at least one adhered permeable patch covers a damage in the at least one permeable silt fence panel in situ, and
      - the at least one adhered permeable patch filters sediment from the sediment-laden stormwater runoff and allows water from the sediment-laden stormwater runoff to escape through a back surface of the at least one adhered permeable patch.

9. The silt fence patch sheet of claim 8, further comprising an adhesive in communication with the back side of the fabric.

10. The silt fence patch sheet of claim 9, further comprising a first side of a backing in communication with the adhesive.

11. The patch of claim 10, wherein the indicia of a plurality of silt fence patches is visible on a second side of the backing.

12. The patch of claim 11, wherein the indicia of a plurality of silt fence patches is selected from the group consisting of a patch identifier, an instruction, a graphic, and combinations thereof.

13. A method comprising:
- identifying damage in a permeable silt fence panel in situ;
- the damage having a damage boundary;
- identifying a fabric weave direction of the damage boundary in situ;
- identifying a patch size to cover the damage boundary;
- selecting a permeable silt fence patch having the identified patch size;
- identifying a patch weave direction of the selected patch;
- aligning the identified patch weave direction of the selected patch with the identified fabric weave direction of the damage boundary in situ;
- applying the selected patch to the damage boundary in situ;

positioning a front surface of the applied patch substantially orthogonally to sediment-laden stormwater runoff, wherein the front surface communicates with the sediment-laden stormwater runoff;

filtering sediment from the sediment-laden stormwater runoff; and allowing water from the sediment-laden stormwater runoff to escape through a back surface of the applied patch.

14. The method of claim 13, wherein the patch having the identified patch size is selected from a plurality of patches.

15. The method of claim 14, further comprising identifying the plurality of patches on a patch sheet and removing the selected patch from the patch sheet.

16. The method of claim 13, wherein the selected patch comprises a permeable geotextile fabric, the fabric having a front side and a back side, and an adhesive in communication with the back side of the fabric.

17. The method of claim 16, wherein the selected patch comprises a backing in communication with the adhesive.

18. The method of claim 17, further comprising removing the backing from the selected patch.

19. The method of claim 13, wherein the aligning allows water from the sediment-laden stormwater runoff to escape through a back surface of the applied patch.

20. The method of claim 13, further comprising smoothing the applied patch.

* * * * *